US006311358B1

(12) United States Patent
Soetewey et al.

(10) Patent No.: US 6,311,358 B1
(45) Date of Patent: Nov. 6, 2001

(54) TOOTHBRUSH COMPRISING GUM-MASSAGING STICKS

(75) Inventors: Lode Soetewey; Lydie Beaugendre, both of Paris (FR)

(73) Assignee: Sanofi-Synthelabo, Paris (FR)

( * ) Notice: Subject to any disclaimer, the term of this patent is extended or adjusted under 35 U.S.C. 154(b) by 0 days.

(21) Appl. No.: 09/601,039

(22) PCT Filed: Jan. 21, 1999

(86) PCT No.: PCT/FR99/00121

§ 371 Date: Jul. 26, 2000

§ 102(e) Date: Jul. 26, 2000

(87) PCT Pub. No.: WO99/37181

PCT Pub. Date: Jul. 29, 1999

(30) Foreign Application Priority Data

Jan. 26, 1998 (FR) ..... 98 00797

(51) Int. Cl.[7] ..... A46B 9/06
(52) U.S. Cl. ..... 15/110; 15/167.1; 15/188
(58) Field of Search ..... 15/110, 167.1, 15/187, 188

(56) References Cited

U.S. PATENT DOCUMENTS 5,040,260 8/1991 Michaels .
5,628,082 * 5/1997 Moskovich ..... 15/188

FOREIGN PATENT DOCUMENTS

| | | |
|---|---|---|
| 90 12 603 | 1/1992 | (DE) . |
| 295 12 817 | 12/1995 | (DE) . |
| 0 360 766 | 3/1990 | (EP) . |
| 02 098310 | 4/1990 | (JP) . |
| WO 95/07036 | 3/1995 | (WO) . |

* cited by examiner

*Primary Examiner*—Randall E. Chin
(74) *Attorney, Agent, or Firm*—Young & Thompson

(57) ABSTRACT

The toothbrush includes a head which is placed at a front longitudinal end of a handle and which is equipped, on an upper face, with a bunch of parallel filaments and a series of rods made from elastomer material which each extend substantially parallel to the filaments and which are placed substantially in two longitudinal rows with one row on each side of the bunch of filaments. Each row of rods includes tall rods which are arranged longitudinally substantially in the center of the row and the length of which is longer than the length of the adjacent filaments and short rods which are arranged at the ends of the row and the length of which is shorter than the length of the adjacent filaments.

15 Claims, 1 Drawing Sheet

FIG.1
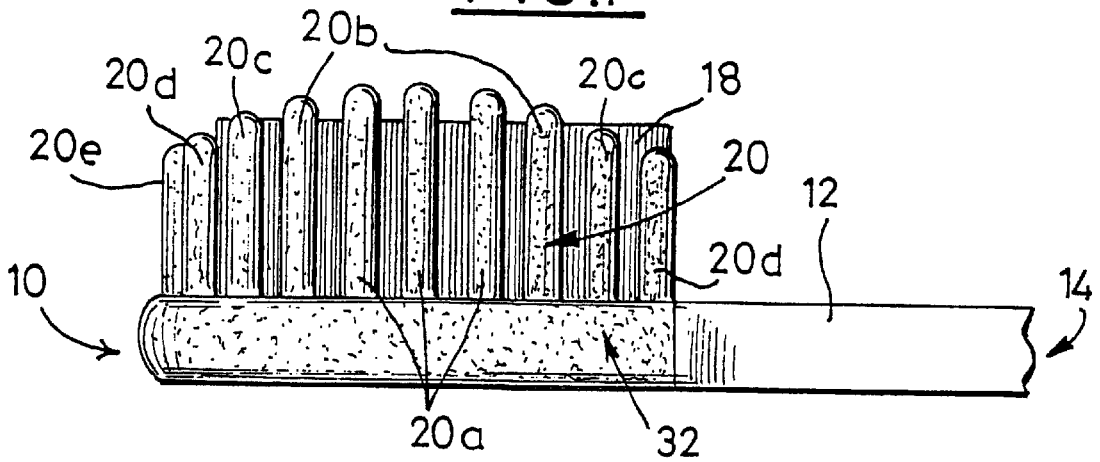
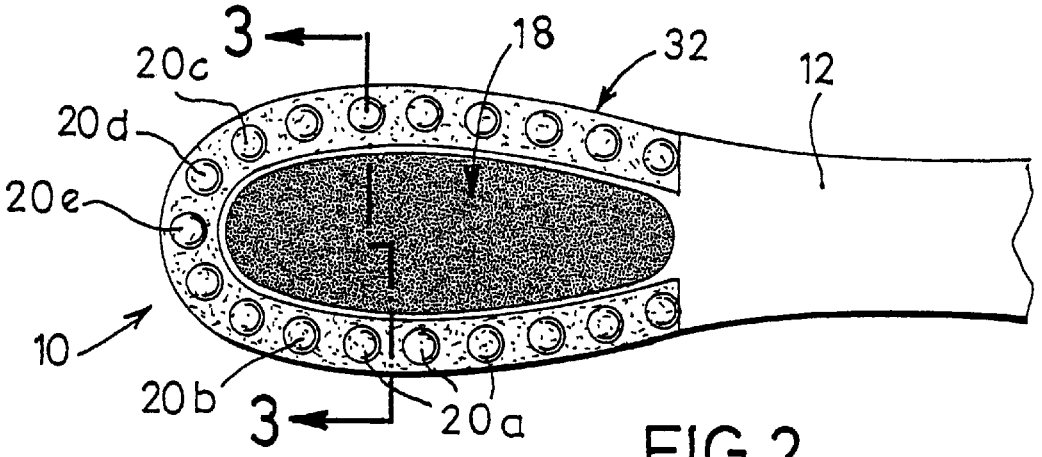
FIG.2
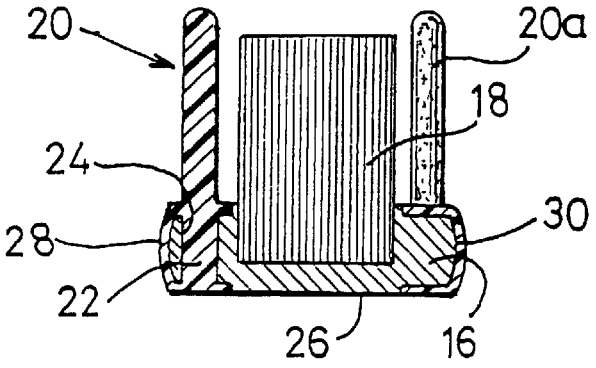
FIG.3

TOOTHBRUSH COMPRISING GUM-MASSAGING STICKS

FIELD OF THE INVENTION

The invention relates to a toothbrush including gum-massaging rods.

The invention relates more particularly to a toothbrush, of the type including a head which is placed at a front longitudinal end of a handle and which is equipped, on an upper face, with a bunch of parallel brushing filaments and of the type in which the brush includes a series of massaging rods made from elastomer material which each extend substantially parallel to the filaments and which are placed substantially in two longitudinal rows with one row on each side of the bunch of filaments.

BACKGROUND OF THE INVENTION

A brush of this type is disclosed in Document WO-A-97/16995. In this document, the toothbrush includes, on each of the longitudinal edges of the head, massaging filaments made from thermoplastic elastomer material which have the same height as that of the brushing filaments made from non-elastomeric plastic.

With this arrangement, it has been noticed that the action of massaging the gums could be insufficient, particularly when the elastomeric filaments are relatively flexible, either owing to the material from which they are made or owing to their diameter. Thus, when the filaments made from elastomer material flex, the filaments made from non-elastomer material are immediately in contact with the gum. In point of fact, as they are more rigid, these non-elastomeric filaments risk damaging the gum.

SUMMARY OF THE INVENTION

The object of the invention is therefore to propose a new design for a toothbrush which makes it possible both to carry out effective brushing of the teeth and massaging of the gums, whilst limiting the possibility of contact pressure between the filaments made from non-elastomer material and the gum on the one hand, but also while limiting the contact pressure of these filaments on the teeth.

To this end, the invention proposes a toothbrush of the type described above, characterized in that each row of rods includes tall rods which are arranged longitudinally substantially in the centre of the row and the length of which is longer than the length of the adjacent filaments, and short rods which are arranged at the ends of the row and the length of which is shorter than the length of the adjacent filaments.

According to further characteristics of the invention:

the toothbrush includes tall rods of various lengths and short rods of various lengths;

the tallest rods have a height which is greater than the height of the adjacent filaments by less than 25%;

the shortest rods have a height which is less than the height of the adjacent filaments by at least 10%;

over a row, the upper ends of the rods are arranged in a curve, the concave surface of which faces downwards;

the rods are cylindrical in shape;

the rods have a diameter which is substantially between 1 and 2.5 millimeters;

the rows of rods extend towards the front beyond the bunch of filaments;

the brush includes at least one short rod arranged in the longitudinal extension of the bunch of filaments;

each rod is fastened to the head by means of a lower-anchoring foot which is received in an anchoring hole made in a head body, the anchoring hole opens out at both its ends in upper and lower faces of the head body and the anchoring foot of the rod extends even with the lower face of the head body and is shaped so as to interact with the lower face in order for it to be impossible for the rod to be extracted upwards;

upper and lower ends of the anchoring foot are arranged above and even with the upper and lower faces, respectively, of the head body, the ends of the anchoring foot are connected by a bridge of material which extends outside the anchoring hole around an outer lateral edge of the head body and, at the lower and upper ends of the anchoring foot, the bridge of material bears against the lower and upper faces of the head body to fasten the rod onto the head;

the group of rods is produced by molding as a single component and the linking bridges of the rods form a protective bead made from elastomer material around the outer lateral edge of the head body;

the protective bead is formed in a hollowed-out impression made in the head body so that the bead is flush with the level of the outer faces of the head body;

the lower face of the head body is covered by a web of elastomer material which is produced as a single component together with the rods;

the rods are produced from elastomeric silicone.

BRIEF DESCRIPTION OF THE DRAWINGS

Further characteristics and advantages of the invention will become apparent on reading the following detailed description, which may be understood with reference to the appended drawings, in which:

FIG. 1 is a side view of the head of a toothbrush in accordance with the teachings of the invention, seen from the side;

FIG. 2 is a top view of the head of the toothbrush in FIG. 1; and

FIG. 3 is a transverse sectional view along the line 3—3 in FIG. 2.

DETAILED DESCRIPTION OF THE PREFERRED EMBODIMENTS

The figures show the head 10 of a toothbrush placed at a front longitudinal end 12 of a handle 14 of the brush.

The head 10 includes a head body 16, for example made from a thermoplastic material such as a polyamide. The head body 16 has substantially a plate shape extending in a longitudinal plane and carries a bunch of parallel filaments 18 which extend perpendicular to the plane of the head body. These filaments, which are intended for brushing teeth, may, for example, be made from a thermoplastic material of the polyamide type or polyethylene type, but they may also consist of natural bristles.

These filaments may be fastened to the head body 16 in different ways. They may, for example, be grouped together in tufts of filaments folded in two and fixed in receptacles made in the upper face of the head body 16 with the aid of metallic inserts. The filaments may also, for example, be fastened by means of their lower end being embedded in the head body 16.

In the example illustrated in the figures, the filaments 18 all have the same height, i.e. they all extend over the same distance above the upper face of the head body 16. The head body 16 has outer lateral edges 30, the contour of which may be substantially similar to that of a racket, and it includes two substantially parallel upper and lower faces 26.

As may be seen, in particular, in FIG. 2, the filaments 18 are grouped together substantially in the centre of the upper face of the head, the edges of the latter being occupied by rods 20 made from elastomer material which extend parallel to the filaments 18 and which are more particularly intended for massaging the gums.

The rods 20 are, for example, made in the form of cylinders with a diameter substantially between 1 and 2.5 mm and they have a rounded upper end in the form of a spherical dome.

The rods 20 are thus uniformly distributed along the lateral edges of the upper face of the head body 16. As the head body 16 in this case has a relatively elongate shape, the lateral edges 30 of the head 10 have only a relatively shallow curve in the plane of the head, except, of course, at their front end, which is substantially in the shape of an arc of a circle.

The rods 20 thus form, on each side of the central bunch of filaments 18, two longitudinal rows placed close to the corresponding edge of the head 10. The front end of the to head 10 also carries rods 20.

In accordance with the teaching of the invention, and as may be seen more particularly in FIG. 1, the rods 20 do not all have the same height and, in particular, they have a variable height in comparison with the height of the adjacent filaments 18.

In the embodiment illustrated in the figures, the head 10 thus includes, in each of the two rows which flank the filaments 18 longitudinally, three rods 20*a,* the height of which is substantially greater than that of the adjacent filaments 18. The rods 20*a* which are the tallest are preferably arranged longitudinally in the centre of each row and their height exceeds that of the filaments by not more than 25%.

When a row is viewed from the side, in a direction perpendicular to the longitudinal direction of the brush, this group of three rods 20*a* is flanked on each side by rods 20*b,* the height of which is between that of the filaments 18 and that of the tallest rods 20*a.*

The rods 20*b* are themselves flanked by rods 20*c,* the height of which is substantially equal to that of the filaments 18.

Finally, the overall assembly formed by the rods 20*a,* 20*b,* 20*c* is itself flanked by rods 20*d,* the height of which is less than that of the adjacent filaments 18.

When the head 10 is viewed from the side, the upper ends of the rods 20 are thus arranged in a substantially symmetrical curve, the curvature of which faces downwards.

Moreover, the toothbrush illustrated in the figures includes a rod 20*e* placed at the front end of the head 10, the length of the rod being less than that of the rods 20*d.*

In all cases, the length of the shortest rods 20 will preferably be less than that of the adjacent filaments 18 by more than 10%.

Naturally, the total number of rods 20 may be less than or greater than that in the exemplary embodiment illustrated in the figures and, similarly, the curve joining the tops of the ends of the rods may have a greater or lesser curvature, this curve, however, being above the upper end of the filaments 18 in the centre of the head and below the longitudinal ends of the head. Provision may be made, for example, for six rods 20*a* instead of three.

This arrangement results in effective brushing of the teeth and massaging of the gums.

Indeed, when the toothbrush is applied to the lateral surfaces of the teeth, inside or outside, one of the two rows of rods is in contact, essentially by means of the tall rods 20*a,* 20*b,* with the gum, whilst the filaments 18 are applied to the teeth themselves.

However, when the brush is applied to the masticatory face of the teeth, the longitudinal direction of the brush then being substantially parallel to the direction of alignment of the teeth, the tallest rods 20*a,* 20*b* are located on either side of the teeth and thus do not interfere with the action of the filaments 18 which may thus clean the surface of the teeth and penetrate into the interdental spaces.

Moreover, the shortest rods and, in particular, those 20*d* and 20*e* placed at the front end of the head 10, tend to limit squashing of the filaments 18 against the teeth.

The rods 20 are preferably made from elastomeric silicone, but it is also possible to produce them in a vulcanized rubbery material or with the aid of a thermoplastic elastomer material.

A further aspect of the invention is the means for fastening the rods 20 to the head body 16.

Indeed, as may be seen, in particular, in FIG. 3, the rods 20 include an anchoring foot 22 which extends inside a cylindrical anchoring hole 24 pierced in the head body 16. Each anchoring hole 24 opens out in both the upper and lower faces of the head body so that the lower end of the anchoring foot 22 of the rod extends even with the lower face 26 of the head body 16.

The lower end of the anchoring foot 22 which extends even with the lower face 26 has a cross section which is larger than that of the anchoring hole 24 so as to prevent any removal of the rod 20 upwards.

According to a particularly advantageous aspect of the invention, the rods 20 are produced by moulding and provision is made for a bridge of material 28, made as a single component with each rod 20, to join the lower and upper ends of the anchoring foot 22 of the rod 20, following the exterior outer lateral edge 30 of the head body 16 around the outside.

At its junctions with the ends of the anchoring foot 22, the bridge of material 28 bears against the upper and lower faces of the head body 16. Thus, forming an integral part of the rod 20, the bridge of material fastens the rod 20 perfectly in its anchoring hole 24.

This characteristic is particularly advantageous when the rod 20 is made from elastomeric silicone of food-grade quality. Indeed, with such a material, it is impossible to produce a reliable chemical link between the rod 20 and the head body 16.

Preferably, all the rods 20 are produced simultaneously by moulding and they are produced as a single component, connected together by means of their respective linking bridge 28.

All the linking bridges 28 therefore form a continuous bead 32 made from elastomer material which completely encircles the contour of the head body 16 and whose purpose is to dampen impacts between the head body 16 and either the teeth or the gum.

Provision is preferably made for the bead 32 thus formed to extend into hollowed-out impressions formed in the upper and lower faces and in the lateral edges of the head body 16 in such a way that the outer surface of the bead 32 is in line with the external faces of the head body 16 and of the handle

14. However, provision may also be made for the bead to have a thickness which is greater at the front end of the head and for it thus to form a protuberance with a view to providing further protection for the teeth and gums.

In a variant, provision may also be made for a web made from elastomer material, covering the lower face 26 of the head body 16, to be produced at the same time as the rods 20.

What is claimed is:

1. Toothbrush comprising:

a handle having a front longitudinal end;

a head at said front longitudinal end of said handle and having a body with an upper face and a lower face;

a bunch of parallel filaments on said upper face; and a series of rods made from elastomer material which each extend from said upper face substantially parallel to said filaments and which are placed substantially in two longitudinal rows with one row on each side of said bunch of filaments, wherein each row of rods includes tall rods arranged longitudinally substantially in the center of the row and having a length longer than the length of said filaments, and short rods arranged at the ends of the row and having a length shorter than the length of said filaments.

2. Toothbrush according to claim 1, wherein said tall rods have various lengths and said short rods have various lengths.

3. Toothbrush according to claim 2, wherein at least one of said tall rods has a height greater than the height of said filaments by less than 25%.

4. Toothbrush according to claim 2, wherein at least one of said short rods has a height which is less than the height of said filaments by at least 10%.

5. Toothbrush according to claim 1, wherein said rods of each row, when viewed from the side of the head perpendicular to the length of the rods, have their upper ends arranged in a curve having a concave surface facing downwards.

6. Toothbrush according to claim 1, wherein said rods are cylindrical in shape.

7. Toothbrush according to claim 1, wherein said rods have a diameter between 1 and 2.5 millimeters.

8. Toothbrush according to claim 1, wherein said rows of rods, at the front end of said head body, extend beyond said bunch of filaments.

9. Toothbrush according to claim 1, wherein at least one of said short rods, at the front end of said head body, extends beyond said bunch of filaments.

10. Toothbrush according to claim 1, further comprising each of said rods having a lower anchoring foot and anchoring holes made in said head body, each of said anchoring holes opens out at both its ends in said upper and lower faces of said head body and said anchoring foot of said rod is received in one of said anchoring holes and extends even with said lower face of said head body and is shaped so as to interact with said lower face in order to be impossible for said rods to be extracted upwards.

11. Toothbrush according to claim 10, wherein upper and lower ends of said anchoring foot are arranged above and even with said upper and lower faces, respectively, of said head body, the ends of said anchoring foot are connected by a bridge of material which extends outside said anchoring hole around an outer lateral edge of said head body and at the lower and upper ends of said anchoring foot, said bridge of material bears against said lower and upper faces of said head body to fasten said rod onto said head.

12. Toothbrush according to claim 11, wherein said rods are produced as a group by molding as a single component and linking bridges of said rods form a protective bead made from elastomer material around said outer lateral edge of said head body.

13. Toothbrush according to claim 12, wherein said protective bead is formed in a hollowed-out impression made in said head body so that said bead is flush with said head body.

14. Toothbrush according to claim 12, wherein said lower face of said head body is covered by a web of elastomer material which is produced as a single component together with said rods.

15. Toothbrush according to claim 1, wherein said rods are produced from elastomeric silicone.

* * * * *